350-96.2 SR
5/13/86 XR 4,587,812

United States Patent [19]

Brega

[11] Patent Number: 4,587,812

[45] Date of Patent: May 13, 1986

[54] ELECTRONICALLY CONTROLLED CIRCULAR KNITTING MACHINE

[75] Inventor: Angelo Brega, Varese, Italy

[73] Assignee: Mec-Mor S.p.A., Induno Olona, Italy

[21] Appl. No.: 616,878

[22] Filed: Jun. 4, 1984

[30] Foreign Application Priority Data

Jun. 15, 1983 [IT] Italy ..... 21643 A/83

[51] Int. Cl.[4] ..... D04B 15/00

[52] U.S. Cl. ..... 66/232; 350/96.2

[58] Field of Search ..... 66/218, 232; 350/96.2; 358/901

[56] References Cited

U.S. PATENT DOCUMENTS

| | | | |
|---|---|---|---|
| 3,317,735 | 5/1967 | Elsasser | 66/232 X |
| 3,922,063 | 11/1975 | Marrone | 358/901 X |
| 4,124,272 | 11/1978 | Henderson et al. | 350/96.2 X |
| 4,167,861 | 9/1979 | Krause et al. | 66/232 X |
| 4,303,300 | 12/1981 | Pressiat et al. | 350/96.2 |
| 4,385,507 | 5/1983 | Sawazaki | 66/140 R |
| 4,398,791 | 8/1983 | Dorsey | 350/96.2 X |
| 4,472,052 | 9/1984 | Löfgren | 350/96.2 X |

FOREIGN PATENT DOCUMENTS

| | | | |
|---|---|---|---|
| 57-82809 | 5/1982 | Japan | 350/96.2 |
| 58-7115 | 1/1983 | Japan | 350/96.2 |

*Primary Examiner*—Wm. Carter Reynolds
*Attorney, Agent, or Firm*—Guido Modiano; Albert Josif

[57] ABSTRACT

To transfer electric control signals between a stationary portion and rotary portion of a machine, in particular a circular knitting machine, a device is disclosed which comprises two optical fiber cables respectively attached, the one to the stationary portion and the other to the rotary portion, and arranged to axially face each other on the rotation axis of the machine rotary portion such that the light flux can be transferred from one fiber to the other. An electro-optical element converts the electric signals, which may be of the digital type, into optical signals, which are applied to one of the optical fiber cables and then received on the other cable through a coupling for free relative coaxial rotation. The signals are again converted into electric signals through an opto-electric element, and then processed to control machine actuators. The transfer arrangement is free of any sliding electric contacts and unaffected by noise and interference.

1 Claim, 3 Drawing Figures

ELECTRONICALLY CONTROLLED CIRCULAR KNITTING MACHINE

BACKGROUND OF THE INVENTION

This invention relates to a device for transferring control or drive signals or pulses between machine portions in mutual rotation relationship, particularly in a circular knitting machine. In order to transfer electric control pulses or signals between a stationary portion and rotating portion of a machine, e.g. between the stationary needle cylinder and rotary cam holding structure in a knitting machine, it has been proposed of using commutator and brush devices. The signals, which are effective to control elements of the machine such as solenoid valves of electro-pneumatic actuators for the needle selection slides, are transferred electrically by sliding contact between the commutator and its related brush.

These prior transfer or transmission devices operate substantially without problems with signals at relatively high voltage or current levels and at industrial range frequencies. However, they may give problems of space cluttering and weight where many components are to be controlled, one commutator and respective brush being generally required for each component to be controlled.

These devices are, above all, unsuitable for use with low level signals, e.g. on the order of some milliamperes and few volts, as are those employed for digital signal transmission in transferring control pulses for certain machine components. In this case, the sliding contact, whose resistance is highly variable, may introduce alterations in the typical electric parameters of the signals, which alterations may be deep ones with respect to the parameter involved and reflect in control errors. The very leads which conduct the signals may be a cause for mutual interference, especially with high frequency signals. Further, they may pick up noise interference which can induce an error in the signal itself.

Where the signal is to be also transferred with the machine at rest, then a different contact resistance occurs from that with the machine in operation, and this may lead to inaccuracies in the value of the signal transmitted in either cases.

Such problems are generally encountered not only with circular knitting machines but also with other machines including rotary portions, such as manufacturing machines in general, packaging machines of the rotating carousel type, machine tools having plural circularly distributed stations, and the like.

SUMMARY OF THE INVENTION

It is a main object of this invention to provide a device as indicated, which is free of the space, weight, interference, and error introduction problems outlined above, and can operate reliably with low control signals or pulses and also with signals transmitted at very high frequencies or sequence rates.

The device must be simple and economical, and affording the ability to transmit signals or pulses in either directions, i.e. from the stationary portion of the machine to the rotary one, and from the rotary portion to the stationary one.

These and other objects, such as will be apparent hereinafter, are accomplished by a device for transferring control or drive signals or pulses between machine portions in mutual rotation relationship, particularly in a circular knitting machine, comprising electric signal or pulse emitting means associated with one of said portions and electric signal or pulse receiving means associated with the other of said portions, characterized in that between said emitting means and said receiving means optical fiber transmitting means and related electro-optical and opto-electric transducers are provided, said optical fiber transmitting means including an optical fiber element attached to the machine stationary portion and an optical fiber element attached to the machine rotating portion, said elements having mutually facing ends laid coaxial with the axis of said rotating portion, thereby the light flow can be transferred from one element to the other.

In a device of this type, wherein the electric signal is converted into an optical signal and then re-converted into an electric signal, transmission takes place without sliding contact and, hence, without any problems from changing resistance at the commutator/brush devices. The optical signal, which is immune from interference and noise of electromagnetic nature affecting electric signals, is optically transferred between the two facing elements which, being disposed on the axis of the rotating portion, constantly remain facing each other as the rotating end turns relatively to the stationary end, thereby signals can be transmitted in the same conditions at any rotational speeds as well as with the machine at rest. The rotary element can be easily centered by simply providing a bearing between the stationary and rotating portions, and by securing the rotary element to the rotating portion of the bearing, as explained hereinafter. This arrangement of the optical fiber elements is specially compact and simple, and lends itself equally well for transmission in either directions.

Advantageously, the transmitted signals may comprise a serial transmission of digital level logic signals which are transmitted from a stationary main electronic unit to a logic unit located on the rotating portion of the machine and adapted to sequentially control a set of actuators located on the rotating portion, such as electromagnets for programmed control of selection slides for the needle jacks in a circular knitting machine. However, the range of possible applications for the inventive device is not restricted to this particular case but encompasses a great many ones.

BRIEF DESCRIPTION OF THE DRAWINGS

Further details and advantages of the invention will be more readily understood from the following description of a device according thereto, given here by way of example and not of limitation with reference to the accompanying illustrative drawings of a preferred embodiment thereof, where.

DESCRIPTION OF THE PREFERRED EMBODIMENTS

The exemplary embodiment of the invention discussed herein below makes reference to a circular knitting machine as a particular application for the inventive device; however, it will be understood that the invention is not restricted to this particular application but may be useful in all those cases where control or drive signals or pulses are to be transferred between a stationary portion and rotary portion of a machine.

Figure 1:
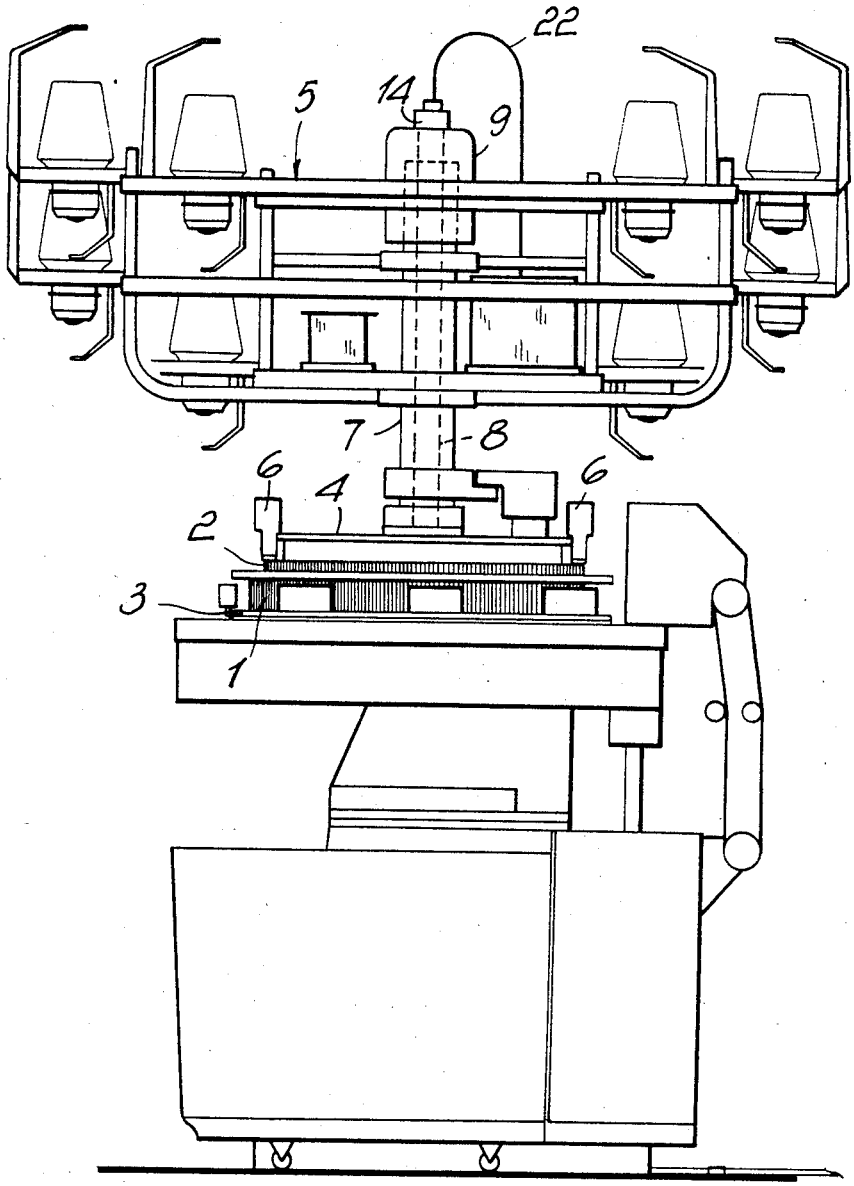
FIG. 1 is a schematic elevation view of a large diameter circular knitting machine incorporating a device according to the invention, by way of example.

The machine shown in FIG. 1 is of the large diameter type and comprises, in a manner known per se, a stationary cylinder 1 and dial 2, and a cam holding structure 3,4 mounted rotatably. Together with the rotating structure 3,4, the reel stick 5 and related yarn feeds 6 are also arranged to rotate as are the needle selection devices.

The reel stick 5 is attached to a hollow shaft 7 carried rotatably in the machine. A fixed shaft 8 extends through the interior of the hollow shaft 7 and is at least partly of hollow construction to accommodate electric leads for the power supply to and control of certain machine components. The fixed shaft 8 extends beyond the rotating shaft 7, which has a cap 9 rigidly attached thereto for accommodating any commutator/brush devices therein, not shown because foreign to this invention.

Figure 2:
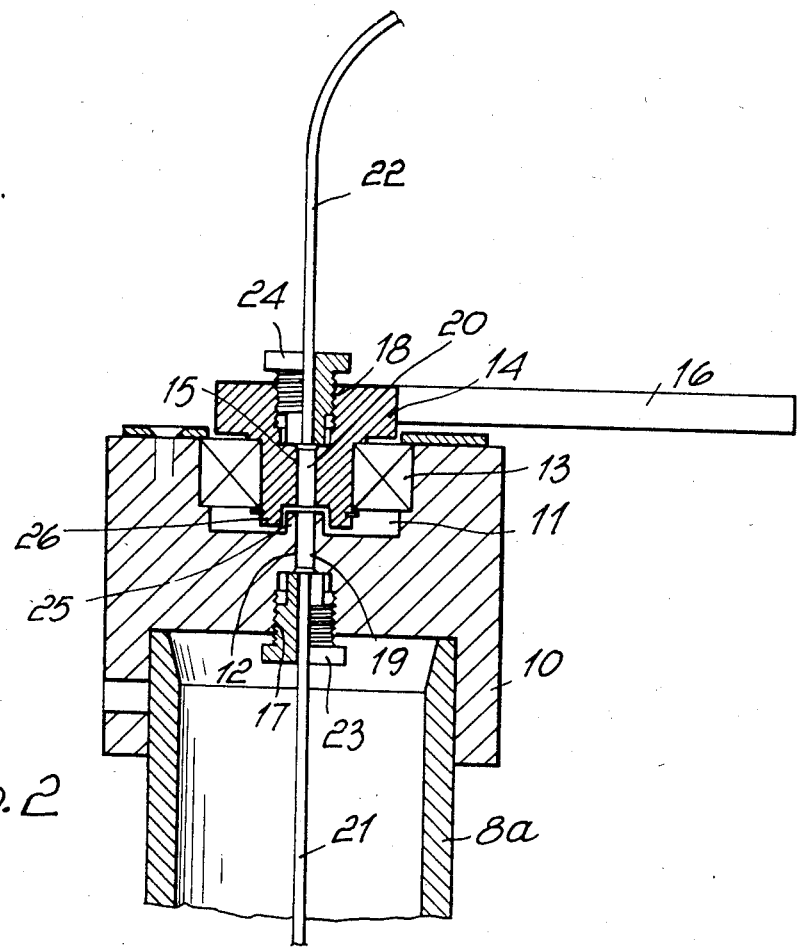
FIG. 2 is a sectional view of one portion of the inventive device, taken through the transition zone between the stationary portion and rotating portion of the machine.

The fixed shaft 8 is terminated with a hollow end 8*a*, best shown in FIG. 2. Attached to this hollow end 8*a*, and coaxially therewith, is a cover 10 of substantially cylindrical shape, which has at the top a substantially cylindrical cavity 11 with an axis coincident with that of the shaft 8, and having a throughgoing axial bore 12. The cavity 11 houses a bearing 13, the rotatable inner portion whereof being coaxially secured to a locating body 14 having a substantially cylindrical portion which protrudes coaxially out of the cover 10. The locating body 14 is also formed with a throughgoing axial bore 15. It is further provided with an arm 16 made rigid with the reel stick 5, thereby the locating body 14 is driven rotatively by the machine rotating portion.

Both the cover 10 and locating body 14, moreover, have respective threaded blind holes 17,18 formed on opposite sides. Attached to the cover 10 and body 14 are respective ends 19,20 of optical fiber elements 21,22 comprising optical fiber cables of a type known per se. More specifically, the end 19 of the optical fiber element 21 is received in geometric fit relationship within the axial through bore 12 and stably retained therein by threading a theaded bushing 23 into the threaded hole 17. The end 20 of the optical fiber element 22 is likewise received to a form fit in the through bore 15 of the locating body 14 and locked therein by means of a threaded bushing 24 which is threaded into the threaded hole 18.

Thus, the two ends 19,20 of the optical fiber elements 21,22 are caused to face each other axially at the axis of the machine rotating portion, the end of the rotating optical fiber element 22 being supported on the stationary portion through the bearing 13. The separating distance between the ends 19,20 is kept small as far as possible, e.g. on the order of a few tenths of a millimeter.

Advantageously, the cover 10 is provided with an axial, substantially cylindrical lug 25 penetrating the cavity 11, and the locating body 14 has an axial annular ridge 26 dimensioned to encircle the lug 25 with some play.

This arrangement has the advantage of preventing dirt from entering the gap between the two ends 19, 20 of the elements 21,22.

The optical fiber element 21 is connected to electric control or drive signal or pulse emitting means with the interposition of an electro-optical transducer, as shortly explained hereinafter. The rotating optical fiber element 22 is connected to electric control or drive signal or pulse receiver means through a respective opto-electric transducer, as shortly explained hereinafter.

The arrangement of the two optical fiber elements 21,22 with respective facing ends 19,20 provides optical fiber transmission means and enables continuous or intermittent transfer of signals between the machine rotating and stationary portions, in identical conditions, whether the machine is being operated or at rest. The rotating end 20, in fact, never changes its position relatively to the stationary end 19, excepting that it will rotate about the axis thereof, which bears no influence on the signal transmission.

Figure 3:
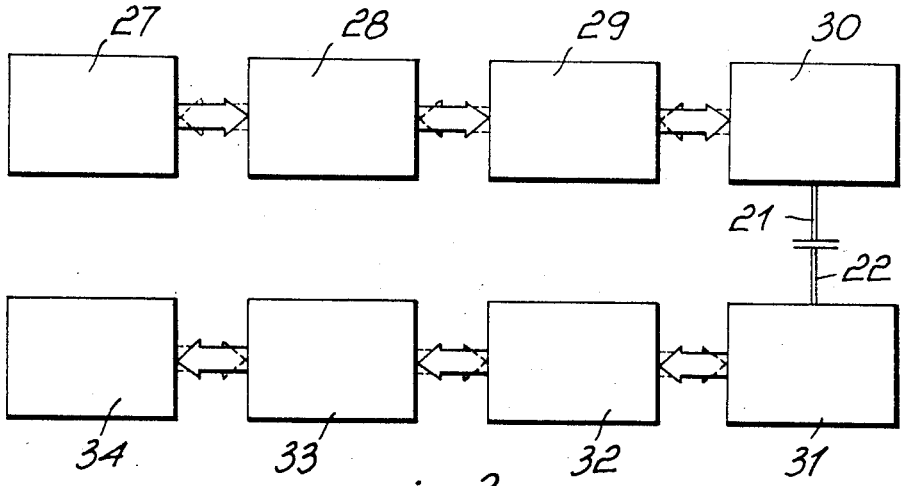
FIG. 3 is a block diagram of an exemplary embodiment of the device of this invention.

An exemplary application of the device just described for controlling the actuators of a circular knitting machine is represented in block diagram form in FIG. 3. From a microprocessor main control unit 27, the control signals in digital form are transmitted to a signal encoder 28, whence the now coded signals are supplied, via an adapter 29, to an opto-emitter element 30. This is located at the opposite end of the optical fiber element 21 from the end 19, and converts the signals into an optical form to then pass them to the optical fiber element 21. The members 27,28,29 and 30 are all located on the machine stationary portion or associated therewith.

Through the optical coupling formed at the ends 19,20 of the elements 21,22, the optical signals are transmitted to the rotating portion and then re-converted to electric signals through an opto-receiver element 31. Then they reach, through an adapter 32, a decoder 33 and then a control or drive interlocked unit 34 of the microprocessor type. The latter would be secured, for example, to the reel stick 5, and sequentially control, through power amplifiers, machine actuators located on the rotating portion, such as electromagnets driving selection slides for the needle jacks, or electromagnets driving movable cams. The members 31,32,33 and 34 are all located on the machine rotating portion.

It may be appreciated that the device just described could also operate in the opposite direction, for example, the signal emitting means could be provided on the moving portion and the receiving ones on the stationary portion, without this requiring any adaptations of the coupling of the optical fiber elements 21,22 at the transition area between the stationary and rotating portions of the machine. The ability to operate in the opposite direction has been indicated in FIG. 3 with dash-line arrows. Optical fiber elements having ends which are provided, or may be provided, with opto-emitter or opto-receiver members are available commercially and require no further discussion.

It will be appreciated from the foregoing that a device according to the invention enables electric signals or pulses to be transferred between a rotating portion and stationary portion of a machine in an extremely simple, economical, and compact way, using means of minimal weight even where a relatively high number of actuators are to be controlled sequentially.

Reference has been made to signals of a digital nature, but it may be appreciated that the signals could have different natures and any patterns.

The invention disclosed hereinabove is susceptible to many modifications and variations without departing from the scope of the instant inventive idea. Thus, as an example, it would be possible to arrange, between the locating body 14 and cover 10, two axially separated bearings, to ensure a more stable axial alignment of the two ends 19,20. The device could also be used on a circular knitting machine having a rotating cylinder and fixed cam holding structure, or on packaging machines, manufacturing machines, machine tools, wherever a need exists for transferring control or drive signals or pulses between a stationary part and a rotary part. Instead of being associated together at the top end portion of the fixed vertical shaft 8 of the machine, the ends 19,20 of the optical fiber elements 21,22 could be associated to each other at some other location on the machine axis.

I claim:

1. A circular knitting machine, in particular a cylinder and dial knitting machine having at least one machine stationary portion and a machine rotating portion defining an axis of rotation, said machine comprising a device for transferring control signals between said machine portions, said device comprising electric signal emitting means associated with one of said portions and electric signal receiving means associated with another of said portions, wherein between said emitting means and said receiving means optical fiber transmitting means and related electro-optical and opto-electric transducers are provided, said optical fiber transmitting means including a first optical fiber element attached to said one machine portion and a second optical fiber element attached to said another machine portion, said elements having mutually facing ends laid coaxial with said rotation axis of said rotating portion, thereby light flux can be transferred from one element to the other, wherein said second optical fiber element is attached to said rotating portion and has an end supported on said stationary portion through at least one bearing, wherein said first optical fiber element is attached to said stationary portion, said stationary portion including a fixed shaft having at least one hollow end coaxially attached to a cover having an axial bore therethrough for accommodating the end of said first optical fiber element, said cover also having at a top portion thereof a substantially cylindrical cavity for rotatably receiving a locating body connected to an end of said second optical fiber element, said locating body being rotatively driven by said rotating portion of the machine and wherein said cover has a substantially cylindrical axial lug penetrating said substantially cylindrical cavity, and said locating body has an axial annular ridge encircling said lug with some play, the machine further comprising, associated with said one machine portion, a microprocessor main control unit, a signal encoder in cascade to said main control unit, an adapter, and an opto-emitter element associated with said first optical fiber element, and, associated with said another machine portion, an opto-receiver element associated with said second optical fiber element, an adapter, a decoder in cascade to said adapter, and an interlocked control unit for sequentially controlling actuators made rigid with said another portion of the machine and wherein said main control unit, said signal encoder, said successive adapter, and said opto-emitter element are associated with a stationary portion of the machine and wherein said optical fiber elements are associated together at a top end portion of said fixed shaft in a circular knitting machine having a fixed cylinder and rotating cam holding structure.

* * * * *